US007455177B2

(12) United States Patent
Serafini et al.

(10) Patent No.: US 7,455,177 B2
(45) Date of Patent: Nov. 25, 2008

(54) PACKET OF CIGARETTES

(75) Inventors: Stefano Serafini, Crevalcore (IT); Fiorenzo Draghetti, Medicina (IT)

(73) Assignee: G.D Societa' Per Aziono, Bologna (IT)

( * ) Notice: Subject to any disclaimer, the term of this patent is extended or adjusted under 35 U.S.C. 154(b) by 346 days.

(21) Appl. No.: 10/546,375

(22) PCT Filed: Feb. 19, 2004

(86) PCT No.: PCT/EP2004/050171

§ 371 (c)(1),
(2), (4) Date: Jan. 4, 2006

(87) PCT Pub. No.: WO2004/074123

PCT Pub. Date: Sep. 2, 2004

(65) Prior Publication Data

US 2006/0157357 A1 Jul. 20, 2006

(30) Foreign Application Priority Data

Feb. 20, 2003 (IT) ..... BO2003A0081

(51) Int. Cl.
*B65D 85/10* (2006.01)

(52) U.S. Cl. ..... 206/268; 206/265; 206/271

(58) Field of Classification Search ..... 206/265, 206/268, 271, 273, 776, 778, 769; 229/160.1
See application file for complete search history.

(56) References Cited

U.S. PATENT DOCUMENTS

| | | | | |
|---|---|---|---|---|
| 1,970,636 | A * | 8/1934 | Tanner | 206/45.21 |
| 5,826,785 | A * | 10/1998 | Belvederi et al. | 229/162.3 |
| 6,138,823 | A * | 10/2000 | Focke et al. | 206/259 |
| 2004/0026271 | A1 * | 2/2004 | Conti et al. | 206/259 |

FOREIGN PATENT DOCUMENTS

| | | |
|---|---|---|
| CH | 690 005 | 3/2000 |
| DE | 19 96 454 | 11/1968 |
| DE | 199 22 602 | 11/2000 |
| GB | 328751 | 5/1930 |
| WO | WO 02/28744 | 4/2002 |

* cited by examiner

*Primary Examiner*—David T Fidei
(74) *Attorney, Agent, or Firm*—Marshall, Gerstein & Borun LLP

(57) ABSTRACT

A packet of cigarettes having a rigid container in turn having a hinged lid; and a group of cigarettes housed inside the container and enclosed in an inner foil wrapping having a front tear-off portion; a front wall of the container has a transparent window superimposed over the front tear-off portion of the inner foil wrapping (FIG. 1).

8 Claims, 3 Drawing Sheets

PACKET OF CIGARETTES

CROSS-REFERENCE TO RELATED APPLICATION

This is the U.S. national phase application of International Application No. PCT/EP2004/050171, filed 19 Feb. 2004, which claims the benefit of Italian patent application number BO 2003A000081, filed 20 Feb. 2003.

TECHNICAL FIELD

The present invention relates to a packet of cigarettes.

BACKGROUND ART

DE8711574U1 describes a packet of cigarettes comprising a rigid container with a hinged lid; and a group of cigarettes housed inside the container and enclosed in a foil wrapping having a front opening. In a front wall, the container has a transparent window, which is superimposed entirely and directly over the front opening in the foil wrapping, so that a front portion of the group of cigarettes is visible from outside the packet of cigarettes.

DE1996454U describes a packet of cigarettes comprising a container; and a group of cigarettes housed inside the container. In a front wall, the container has a transparent window, so that a front portion of the group of cigarettes is visible from outside the packet of cigarettes.

The above documents DE8711574U1 and DE1996454U each describe a packet of cigarettes comprising a container having a transparent window, so that a portion of the group of cigarettes is visible from outside the packet of cigarettes, thus enabling the user of the packet to see the contents and how many cigarettes are left inside the packet, without the packet having to be opened.

The packets of cigarettes described in DE8711574U1 and DE1996454U, however, have been found to have a major drawback. That is, new packets are normally displayed for sale by retailers in display fixtures, in which a packet of cigarettes may remain unsold for several days. In which case, the packet of cigarettes may be exposed to artificial light, and especially sunlight, which, on striking the exposed portion of the cigarettes through the transparent window, tends to alter the colour of the cigarettes at the exposed portion, thus rendering the packet unsaleable.

DISCLOSURE OF INVENTION

It is an object of the present invention to provide a packet of cigarettes designed to eliminate the aforementioned drawbacks, and which, at the same time, is cheap and easy to produce.

According to the present invention, there is provided a packet of cigarettes comprising a container in turn comprising a wall having a window; and a group of cigarettes housed inside the container; the packet being characterized in that the group of cigarettes is enclosed in an inner wrapping having a tear-off portion located facing the window so as to internally and at least partly cover the window.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 3:
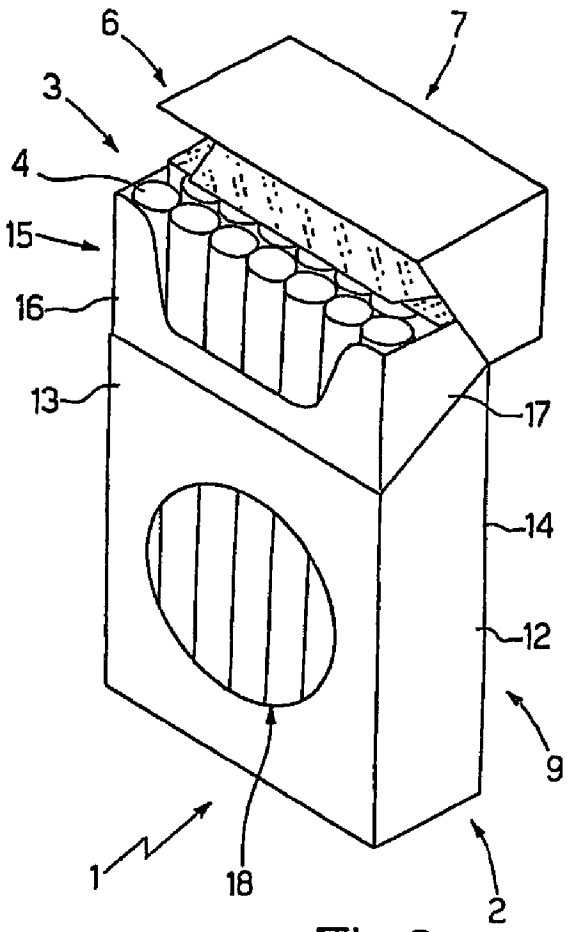
FIG. 3 shows a front view in perspective of the FIG. 1 packet in an open configuration and without a removable front portion of a foil wrapping.
Figure 2:
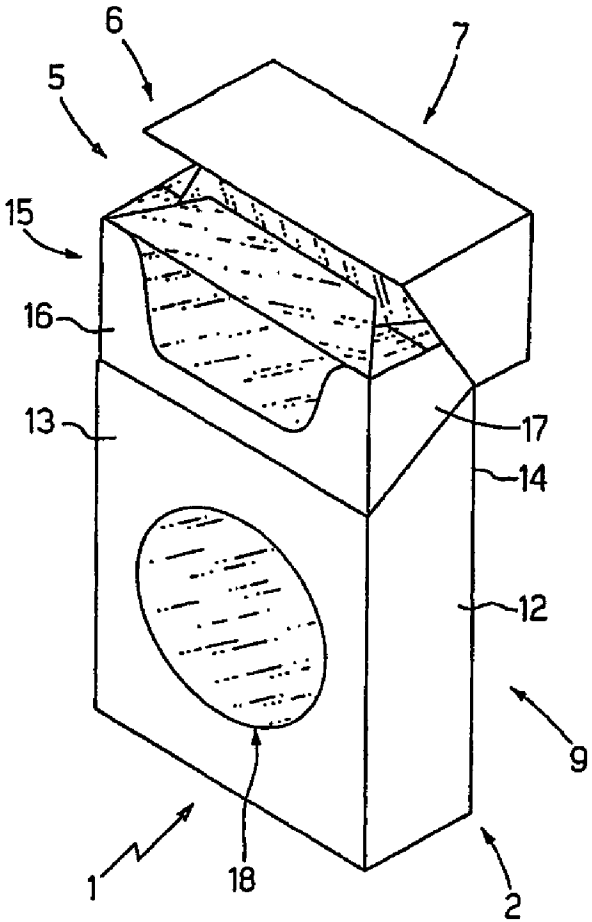
FIG. 2 shows a front view in perspective of the FIG. 1 packet in an open configuration.
Figure 1:
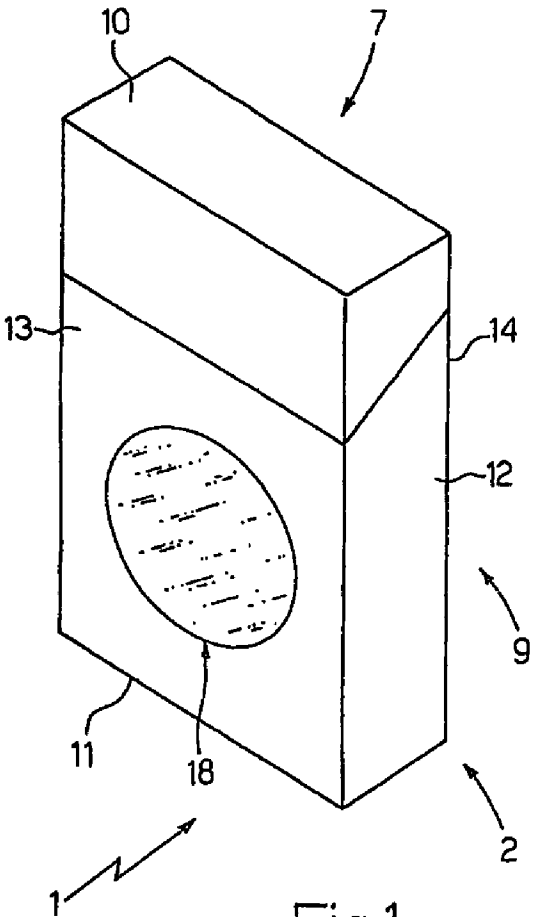
FIG. 1 shows a front view in perspective of a packet of cigarettes in accordance with the present invention and in a closed configuration.
Figure 4:
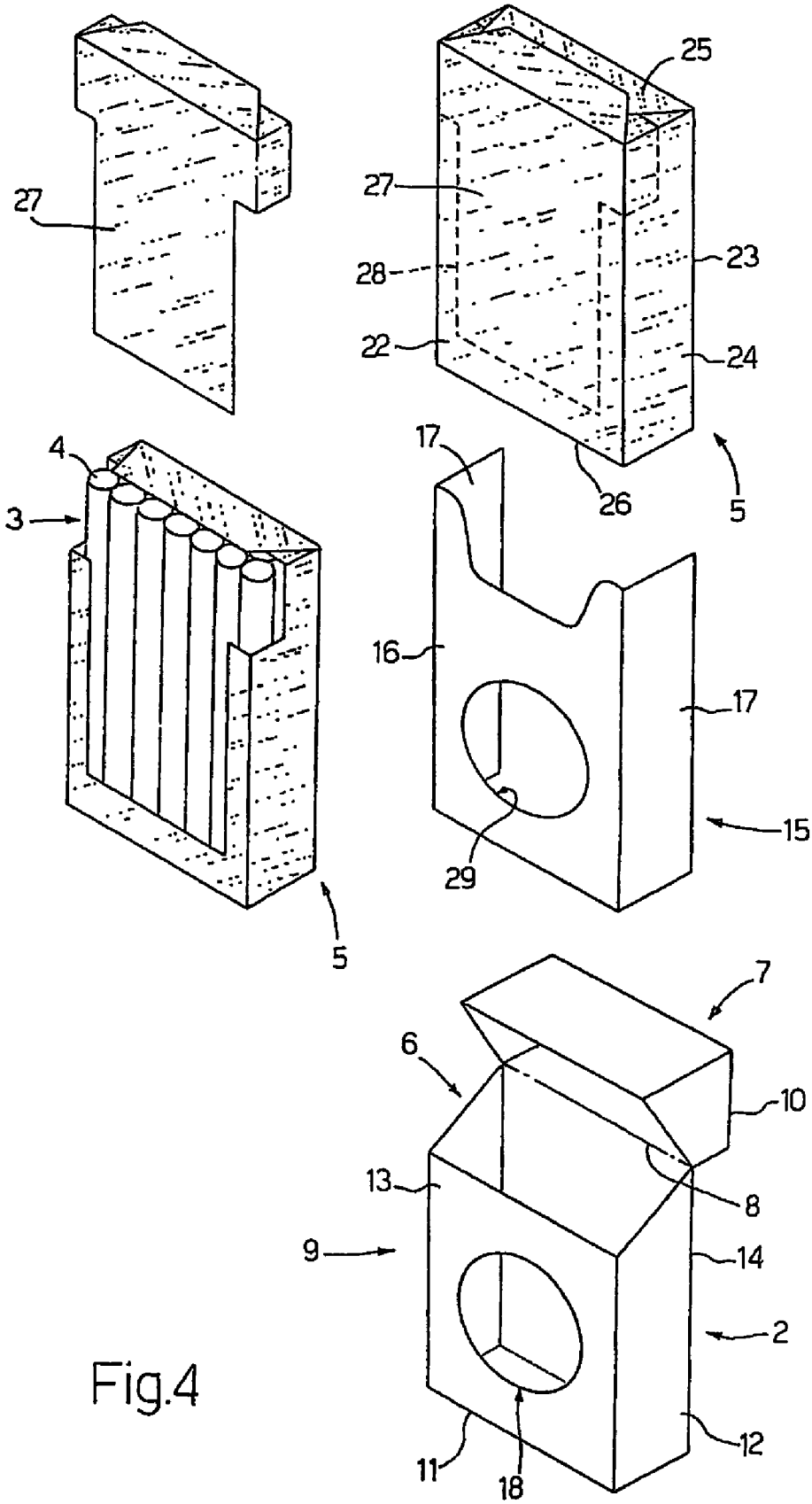
FIG. 4 shows an exploded view in perspective of the FIG. 1 packet of cigarettes.

Number 1 in FIG. 1 indicates as a whole a rigid packet of cigarettes, which comprises a cup-shaped container 2, and a group 3 of cigarettes 4; which group 3 is substantially parallelepiped-shaped, is enclosed in a foil wrapping 5, and is housed inside container 2. Container 2 comprises an open top end 6; and a cup-shaped lid 7 hinged to container 2 along a hinge 8 to rotate, with respect to container 2, between an open position (FIGS. 2 and 3) and a closed position (FIG. 1) respectively opening and closing open top end 6.

When lid 7 is in the closed position, container 2 is in the form of a substantially rectangular parallelepided defined by a lateral surface 9, and by two flat, identical, respectively top and bottom, end walls 10 and 11 facing and parallel to each other and which bound lateral surface 9.

Lateral surface 9 comprises two flat minor lateral walls 12 facing and parallel to each other; and two flat major lateral walls 13 and 14 facing each other and crosswise to minor lateral walls 12. More specifically, one major lateral wall 13 defines a front wall of container 2, and the other major lateral wall 14 defines a rear wall of container 2.

Packet 1 also comprises a collar 15, which is fitted (glued), in a U-folded position, inside container 2, so as to project partly outwards of top open end 6 and engage a corresponding inner surface of lid 7 when lid 7 is in said closed position (FIG. 1). More specifically, collar 15 comprises a front wall 16 which is connected to front wall 13 of container 2; and two lateral walls 17 located on opposite sides of front wall 16 and connected to minor lateral walls 12 of container 2.

Figure 5:
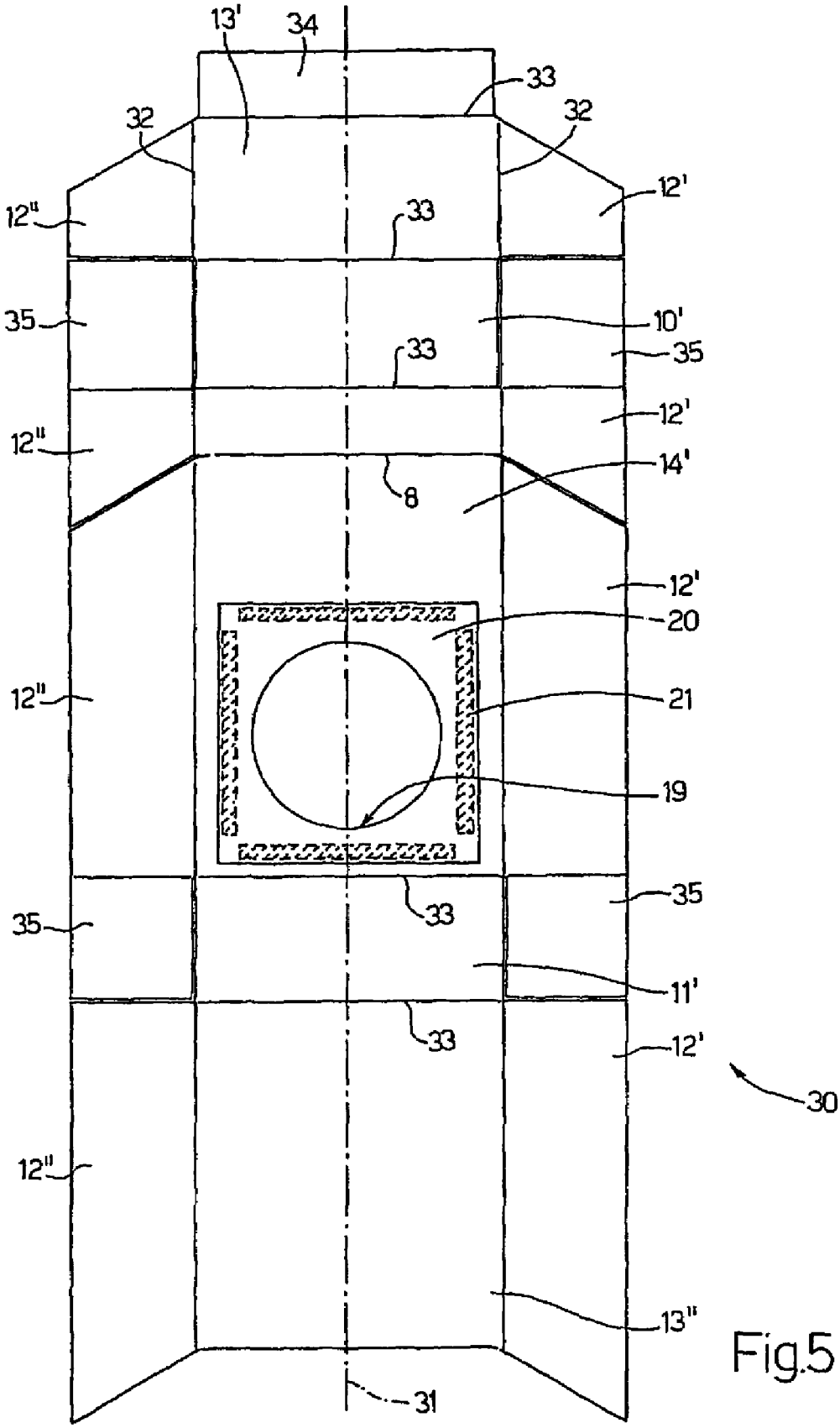
FIG. 5 shows a plan view of a blank by which to form the FIG. 1 packet.

Front wall 13 of container 2 comprises a transparent window 18, which is defined by a through hole 19 (FIG. 5) in front wall 13, and by a sheet 20 (FIG. 5) of transparent plastic material connected to an inner surface of front wall 13 by a bead 21 of glue (FIG. 5).

The inner wrapping 5 is in the form of a substantially rectangular parallelepiped defined by a front wall 22; a rear wall 23 parallel to and opposite front wall 22; two opposite, parallel lateral walls 24; a top end wall 25; and a bottom end wall 26 parallel to and opposite top end wall 25.

Inner wrapping 5 also comprises a tear-off portion 27, which involves a portion of front wall 22, a portion of top end wall 25, and respective portions of lateral walls 24. More specifically, tear-off portion 27 is marked off from the rest of inner wrapping 5 by a tear line 28, and is located directly contacting transparent window 18 so as to cover transparent window 18 internally. When packet 1 is new, group 3 of cigarettes 4 is not visible from outside packet 1, by being covered by inner wrapping 5. When container 2 is unsealed by the user, the user tears off tear-off portion 27 of inner wrapping 5 to remove cigarettes 4 from inner wrapping 5; and, once tear-off portion 27 is removed, group 3 of cigarettes 4 is visible from outside packet 1 through transparent window 18.

The bottom part of tear-off portion 27 is preferably of a width, i.e. transverse dimension, substantially similar to (i.e. equal to or slightly greater than) the width of transparent window 18, since tear-off portion 27 must be as narrow as possible to prevent cigarettes 4 from being raised by friction as tear-off portion 27 is removed.

Collar 15 must therefore be so designed as not to cover transparent window 18 when fitted inside container 2. In the preferred embodiment shown in the accompanying drawings, front wall 16 of collar 15 comprises a hole 29, which is at least the same size as, and is superimposed over, transparent window 18. This solution is particularly advantageous by permitting a front wall 16 of collar 15 of similar size to that of front wall 13 of container 2, and which therefore aids in ensuring the necessary rigidity and solidity of the front portion of container 2, despite the presence of transparent window 18.

As shown in FIG. 5, container 2 is formed from a corresponding flat blank 30, which is substantially in the form of an elongated rectangle, and the parts of which are indicated, wherever possible, using the same references numbers, with superscripts, as for the corresponding parts of container 2.

Blank 30 (which has a longitudinal centreline axis 31) comprises two longitudinal fold lines 32, and a number of transverse fold lines 33 defining, between the two longitudinal fold lines 32, a panel 13' defining a top portion of front wall 13 (in particular, the portion forming part of lid 7); a panel 10' defining top end wall 10; a panel 14' defining rear wall 14; a panel 11' defining bottom end wall 11; and a panel 13" defining a bottom portion of front wall 13.

Each panel 13', 13", 14' has two lateral wings 12' and 12", which are located on opposite sides of relative panel 13', 13", 14', and are separated from respective panel 13', 13", 14' by longitudinal fold lines 33. Panel 13' has a reinforcing flap 34, and each wing 12', 12" of panel 14' has respective rectangular longitudinal appendixes 35 located at opposite ends of wing 12', 12" and aligned longitudinally with each other.

When forming each packet 1, lateral wings 12' and lateral wings 12' are superimposed and glued together to define minor lateral walls 12 of container 2. And each longitudinal appendix 35 is folded squarely with respect to respective lateral wing 12' or 12", and is superimposed on and glued to an inner surface of a respective panel 10' or 11' to define an inner portion of a relative end wall 10 or 11 of packet 1.

In a different embodiment, wrapping 5 containing group 3 of cigarettes 4 is made of wrapping material other than foil, e.g. paper or plastic material.

In a further embodiment not shown, some longitudinal and/or transverse edges of container 2 are bevelled or rounded, or container 2 comprises one or more convex lateral walls 12, 13, 14. Alternatively, container 2 may be other than parallelepiped-shaped, e.g. may have an oval or triangular cross section.

The accompanying drawings show a rigid packet 1 of cigarettes, which comprises a rigid container 2 formed by folding a rigid sheet of packing material (blank 30) about group 3 of cigarettes 4. Alternatively, packet 1 of cigarettes may be a soft type comprising a soft container 2 formed by folding a sheet of soft packing material about group 3 of cigarettes 4, in which case, the soft container 2 obviously has no lid 7 or collar 15.

Packet 1 of cigarettes therefore provides for protecting cigarettes 4 against deterioration by light prior to unsealing packet 1 of cigarettes, as well as for enabling the user to see the content of packet 1 of cigarettes without opening it, once packet 1 of cigarettes is unsealed. Moreover, the user can tell immediately whether packet 1 of cigarettes has been unsealed or not. That is, if cigarettes 4 are not visible through transparent window 18, this means tear-off portion 27 of inner wrapping 5 is still in the original position, and packet 1 of cigarettes is still sealed.

The invention claimed is:

1. A packet of cigarettes comprising a container (2) in turn comprising a wall (13) having a window (18) and an open top end (6);

a lid (7) hinged to the container (2) along a hinge (8) to rotate, with respect to the container (2), between an open position and a closed position respectively opening and closing the open top end (6);

a collar (15) fitted inside the container (2) so as to project partly outwards of the open top end (6) and engage a corresponding inner surface of the lid (7) when the lid (7) is in the closed position; wherein the collar (15) is designed so as not to cover the window (18) when fitted inside the container (2);

a group (3) of cigarettes (4) housed inside the container (2); and an inner wrapping (5) enclosing the group (3) of cigarettes (4) and having a tear-off portion (27) located facing the window (18) so as to internally and at least partly cover the window (18); wherein once the tear-off portion (27) is removed, the group (3) of cigarettes 4 is visible from outside the packet (1) through the window 18.

2. The packet as claimed in claim 1, wherein the window (18) is defined by a through hole (19) in the relative wall (13) of the container.

3. The packet as claimed in claim 1, wherein the window (18) is a transparent window defined by a through hole (19) in the relative wall (13) of the container, and by a sheet (20) of transparent plastic material glued to the container (2) at the hole (19).

4. The packet as claimed in claim 3, wherein the sheet (20) of transparent plastic material is glued to an inner surface of the corresponding wall (13) of the container (2).

5. The packet as claimed in claim 1, wherein the container (2) is substantially parallelpiped-shaped, and comprises two, respectively top and bottom, end walls (10, 11), and a lateral surface (9) bounding the end walls (10, 11) and defined by two, respectively front and rear, major lateral walls (13, 14), and by two minor lateral walls (12); the window (18) being located in the front major lateral wall (13) of the container (2); and the tear-off portion (27) comprising at least part of a front wall (13) of the inner wrapping (5).

6. The packet as claimed in claim 1, wherein the collar (15) has a front wall (16) connected to an inner surface of the front major lateral wall (13) of the container (2) and having a hole (29), which is at least the same size as the window (18) and is superimposed over the window (18).

7. The packet as claimed in claim 5, wherein the bottom portion of the tear-off portion (27) is substantially the same width as the window (18).

8. The packet as claimed in claim 1, wherein the portion of the tear-off portion (27) superimposed over the window (18) is substantially the same width as the window (18).

* * * * *